US009016449B1

(12) United States Patent
Soboyejo

(10) Patent No.: US 9,016,449 B1
(45) Date of Patent: Apr. 28, 2015

(54) BRIEFCASE AND BACKPACK LUGGAGE

(71) Applicant: Oluwakemi S. Soboyejo, Las Vegas, NV (US)

(72) Inventor: Oluwakemi S. Soboyejo, Las Vegas, NV (US)

( * ) Notice: Subject to any disclaimer, the term of this patent is extended or adjusted under 35 U.S.C. 154(b) by 0 days.

(21) Appl. No.: 14/048,310

(22) Filed: Oct. 8, 2013

(51) Int. Cl.
*A45C 5/06* (2006.01)
*A45C 5/00* (2006.01)

(52) U.S. Cl.
CPC ..... *A45C 5/00* (2013.01)

(58) Field of Classification Search
USPC ..... 190/100, 109, 111, 112; 150/106, 111, 150/113, 117, 123; 206/214, 320, 553, 570, 206/579; 224/153, 155, 262, 576, 580, 653, 224/657; 402/4, 73, 79; D19/26, 27; D3/216, 217, 233, 256, 283, 286, 336
See application file for complete search history.

(56) References Cited

U.S. PATENT DOCUMENTS

| | | | | |
|---|---|---|---|---|
| 2,406,785 | A | 9/1946 | Atwood | |
| 3,142,495 | A | 7/1964 | Lu | |
| 5,242,237 | A | 9/1993 | Wagner | |
| 5,489,021 | A | 2/1996 | Wallingford | |
| 5,911,441 | A | 6/1999 | Yamamoto | |
| D417,889 | S | 12/1999 | French | |
| 8,079,452 | B2 * | 12/2011 | Drew et al. | 190/109 |
| 8,413,808 | B1 * | 4/2013 | Tong | 206/320 |
| 2009/0242601 | A1 | 10/2009 | Inman | |

* cited by examiner

*Primary Examiner* — Fenn Mathew
*Assistant Examiner* — Cynthia Collado
(74) *Attorney, Agent, or Firm* — Kyle A. Fletcher, Esq.

(57) ABSTRACT

The briefcase and backpack luggage includes a housing that may carry a plurality of items. The housing comprises a case portion of the housing that may store the items. A folder portion of the housing is coupled to the case portion of the housing. The folder portion of the housing may store items. A handle is coupled to the housing. The handle may be gripped. A strap is coupled to the housing. The strap may be positionable on the user so the housing is retained on the user.

15 Claims, 5 Drawing Sheets

BRIEFCASE AND BACKPACK LUGGAGE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of luggage, more specifically, a backpack and briefcase integrated together.

SUMMARY OF THE INVENTION

An embodiment of the disclosure meets the needs presented above by generally comprising a housing that may carry a plurality of items. The housing comprises a case portion of the housing that may store the items. A folder portion of the housing is coupled to the case portion of the housing. The folder portion of the housing may store items. A handle is coupled to the housing. The handle may be gripped. A strap is coupled to the housing. The strap may be positioned on the user so the housing is retained on the user. Moreover, the strap may be either hidden inside of the multipurpose carrying assembly or taken out to be used.

An object of the invention is to provide a device that is a backpack and optionally a suitcase.

These together with additional objects, features and advantages of the briefcase and backpack luggage will be readily apparent to those of ordinary skill in the art upon reading the following detailed description of presently preferred, but nonetheless illustrative, embodiments of the briefcase and backpack luggage when taken in conjunction with the accompanying drawings.

In this respect, before explaining the current embodiments of the briefcase and backpack luggage in detail, it is to be understood that the briefcase and backpack luggage is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the briefcase and backpack luggage.

It is therefore important that the claims be regarded as including such equivalent construction insofar as they do not depart from the spirit and scope of the briefcase and backpack luggage. It is also to be understood that the phraseology and terminology employed herein are for purposes of description and should not be regarded as limiting.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
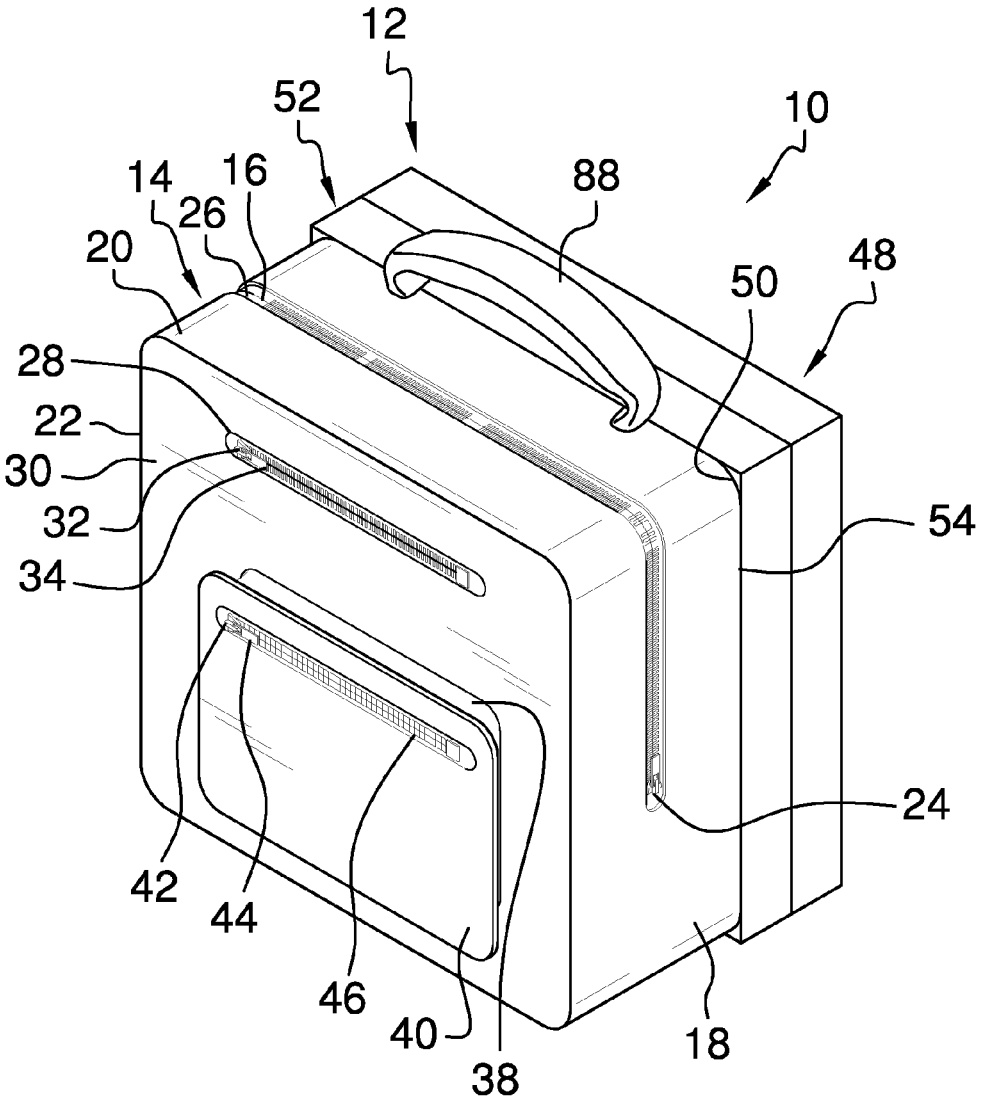
FIG. 1 is a left side perspective view of a multipurpose carrying assembly according to an embodiment of the disclosure.
Figure 2:
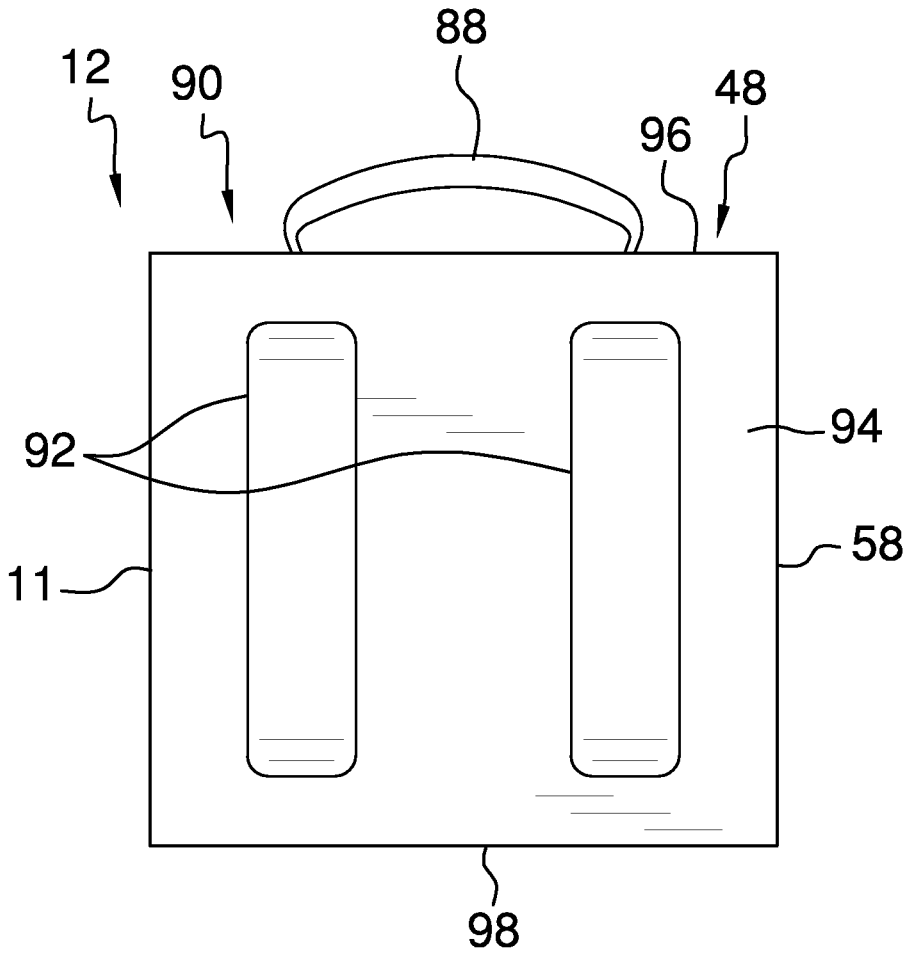
FIG. 2 is a back view of an embodiment of the disclosure.
Figure 3:
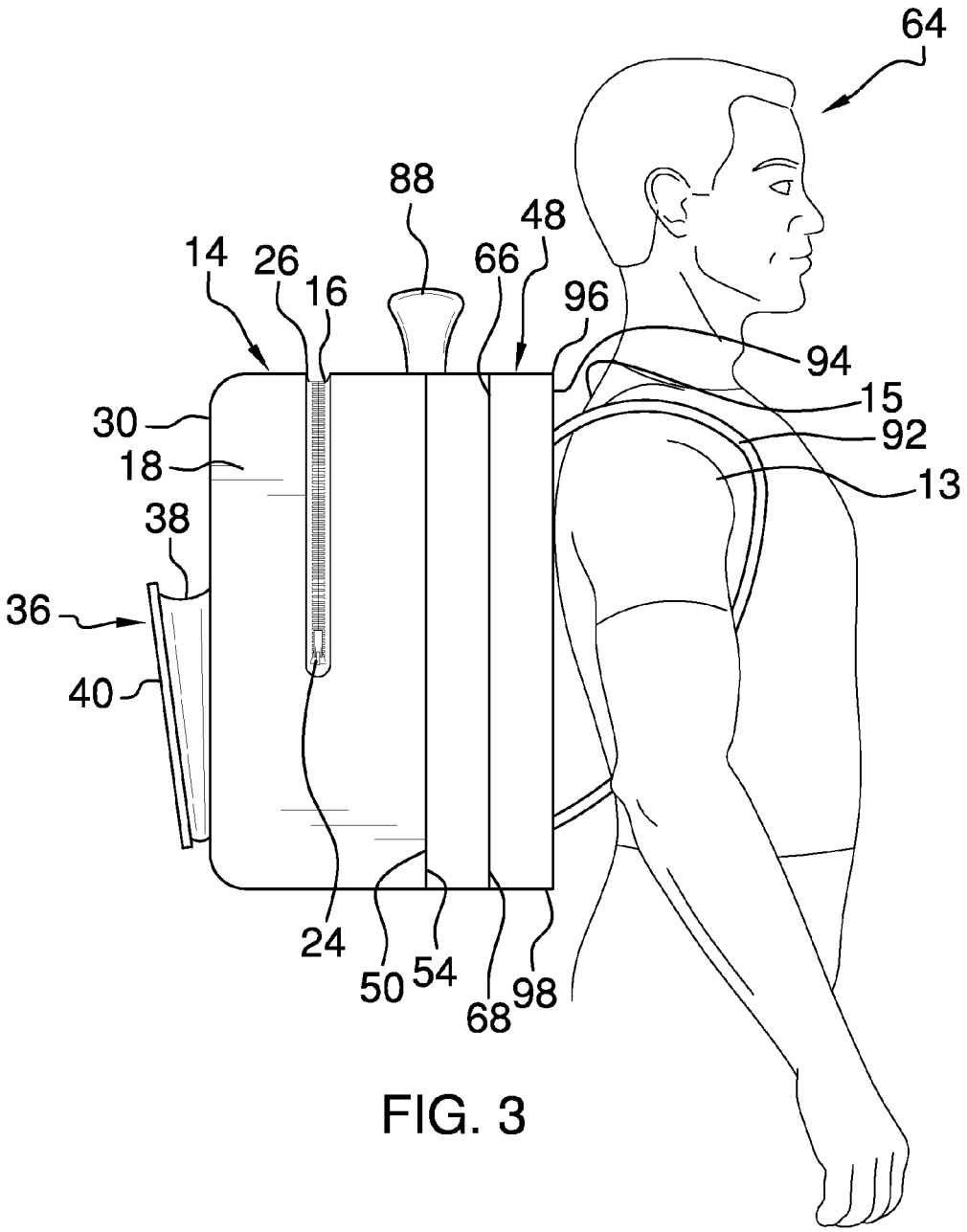
FIG. 3 is a left side view of an embodiment of the disclosure.
Figure 4:
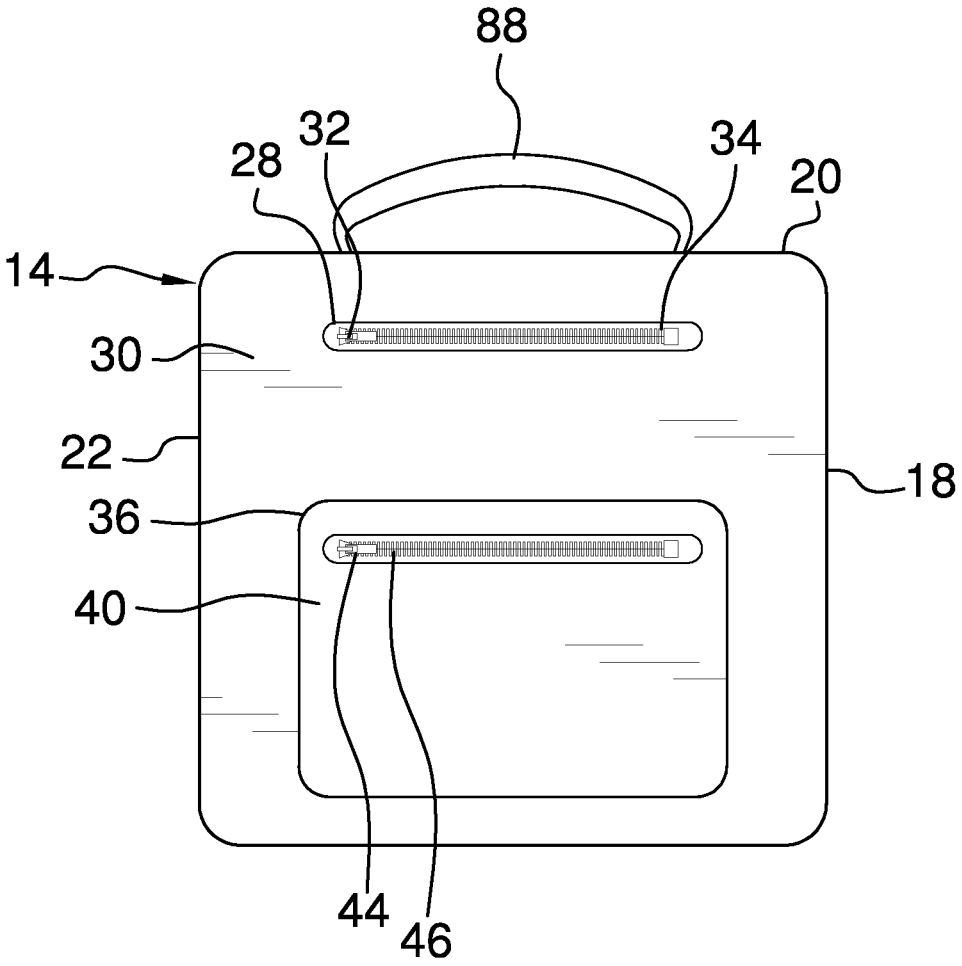
FIG. 4 is a front view of an embodiment of the disclosure.
Figure 5:
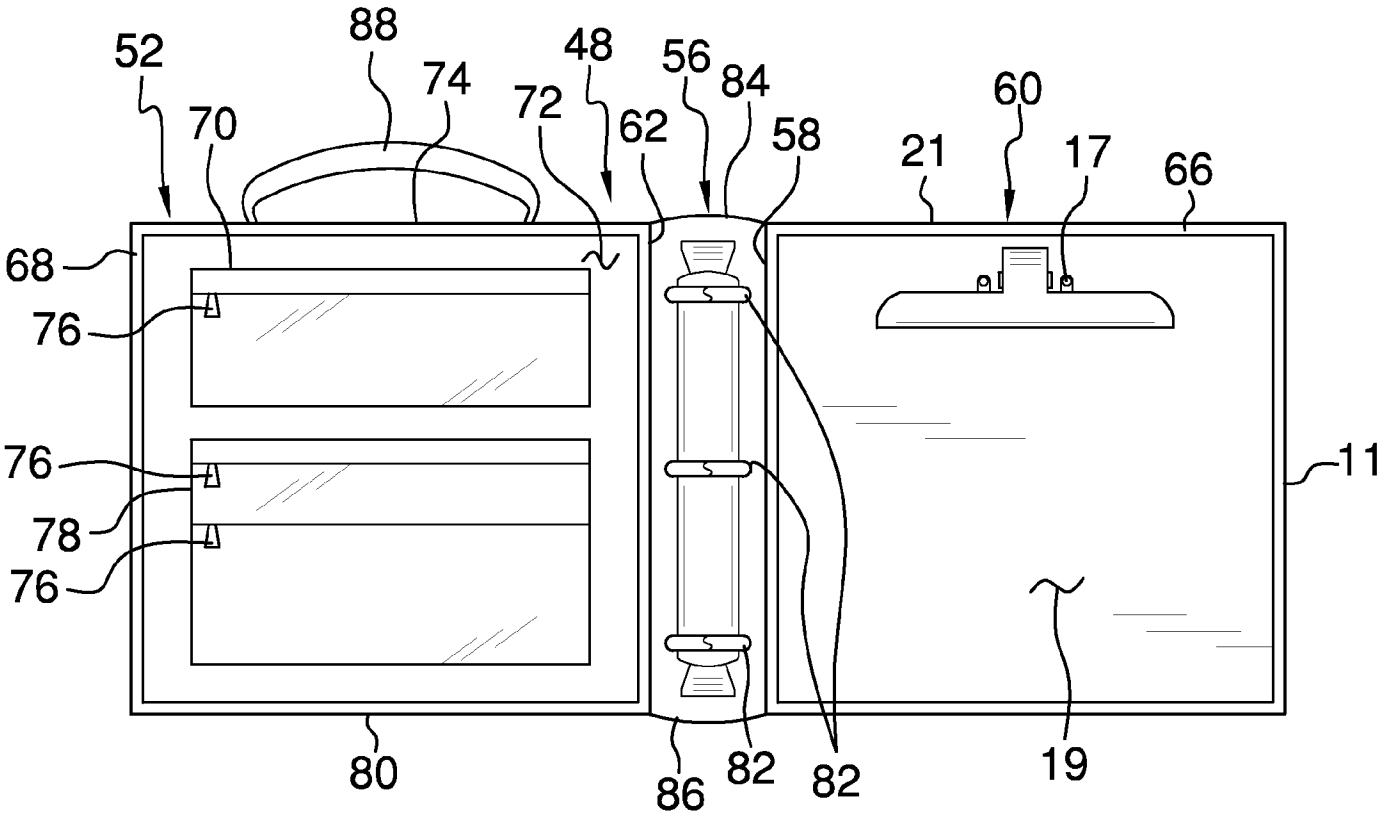
FIG. 5 is an in-use view of an embodiment of the disclosure.

As best illustrated in FIGS. 1 through 5, the multipurpose carrying assembly 10 generally comprises a housing 12 that has a cubic shape that may have a height between 33 cm and 43 cm, and width between 30 cm and 35 cm and a depth between 18 cm and 23 cm. The housing 12 may store a plurality of items in an interior of the housing 12. A case portion 14 of the housing 12 may selectively store the items within an interior of the case portion 14 of the housing. The case portion 14 of the housing 12 may be utilized in the convention of a briefcase. Moreover, the case portion 14 of the housing 12 may have a depth between 7 cm and 13 cm.

A primary access slot 16 extends along a first lateral side 18, a top side 20 and a second lateral side 22 of the case portion 14 of the housing 12 to access the interior of the case portion 14 of the housing 12. Additionally, a primary fastener 24 is coupled to a perimeter edge 26 of the primary access slot 16. The primary fastener 24 selectively closes the primary access slot 16. Moreover, the primary fastener 24 may comprise a zipper of any conventional design.

A secondary access slot 28 extends through a front side 30 of the case portion 14 of the housing 12 to access an interior of the case portion 14 of the housing 12. The secondary access slot 28 may have a length between 17 cm and 22 cm. Ideally, the secondary access slot 28 is about 9 inches in length. Continuing, a secondary fastener 32 is coupled to a perimeter edge 34 of the secondary access slot 28. The secondary fastener 32 selectively closes the secondary access slot 28. Finally, the secondary fastener 32 may comprise a zipper of any conventional design.

A pocket 36 is coupled to the front side 30 of the case portion 14 of the housing 12. The pocket 36 may have a width between 19 cm and 24 cm. Ideally, the pocket 36 is about 7 inches in width. Additionally, the pocket 36 is positioned below the secondary access slot 28. An outer wall 38 of the pocket 36 is flexible. Moreover, a front side 40 of the pocket 36 is positionable between a minimum and a maximum distance from the front side 30 of the case portion 14 of the housing 12.

A pocket slot 42 extends through the front side 40 of the pocket 36 to access an interior of the pocket 36. The pocket slot 42 may have a length between 17 cm and 22 cm. Additionally, a pocket fastener 44 is coupled to a perimeter edge 46 of the pocket slot 42. The pocket fastener 44 selectively closes the pocket slot 42. Lastly, the pocket fastener 44 may comprise a zipper of any conventional design.

A folder portion 48 of the housing 12 comprises a front side 50 of a front portion 52 of the folder portion 48 of the housing 12 that is coupled to a back side 54 of the case portion 14 of the housing 12. The folder portion 48 of the housing 12 may have a depth between 4 cm and 10 cm, and ideally about 3 inches. A central portion 56 of the folder portion 48 of the housing 12 is hingedly coupled between a first lateral edge 58 of a back portion 60 of the folder portion 48 of the housing 12 and a second lateral edge 62 of the front portion 52 of the folder portion 48 of the housing 12. Moreover, the central portion 56 of the folder portion 48 of the housing 12 may have a width between 5 cm and 7.5 cm. The folder portion 48 of the housing 12 may be utilized in the convention of a binder.

The folder portion 48 of the housing 12 is positionable in an open position. The back portion 60 of the folder portion 48 of the housing 12 extends laterally away from the front portion 52 of the folder portion 48 of the housing 12 so an interior of the folder portion 48 of the housing 12 is accessible to a user 64. Moreover, the folder portion 48 of the housing 12 is positionable in a closed position. A raised perimeter edge 66 of the back portion 60 of the folder portion 48 of the housing 12 coextensively abuts a raised perimeter edge 68 of the front portion 52 of the folder portion 48 of the housing 12 so the interior of the folder portion 48 of the housing 12 is concealed. Lastly, the raised perimeter edge 66 of each of the front 52 and back 60 portions of the folder portion 48 of the housing 12 may have a height between 6 mm and 12 mm.

A top pocket 70 is coupled to an inside surface 72 of the front portion 52 of the folder portion 48 of the housing 12 proximate a top 74 of the front portion 52 of the folder portion 48 of the housing 12. The top pocket 70 may have a width between 19 cm and 24 cm and a height between 5 cm and 13 cm. A fastener 76 is coupled to the top pocket 70 to allow access to an interior of the top pocket 70. The fastener 76 may be a zipper of any conventional design.

A bottom pocket 78 is coupled the inside surface 72 of the front portion 52 of the folder portion 48 of the housing 12 proximate a bottom 80 of the front portion 52 of the folder portion 48 of the housing 12. The bottom pocket 78 may have a width between 19 cm and 24 cm and a height between 9 cm and 12 cm. A fastener 76 is coupled to the bottom pocket 78 to allow access to an interior of the bottom pocket 78. The fastener 76 may be a zipper of any conventional design.

A retainer 82 is coupled to the central portion 56 of the folder portion 48 of the housing 12. The retainer 82 comprises a broken loop. Further, the retainer 82 is positionable between an open position and a closed position. The retainer 82 is one of a plurality of retainers 82 that are evenly distributed between a top 84 and a bottom 86 of the central portion 56 of the folder portion 48 of the housing 12. Continuing, the retainer 82 may be used to retain a plurality of pages in the folder portion 48 of the housing 12. Lastly, the retainer 82 may comprise a three ring binder of any conventional design.

A handle 88 is coupled to a top 90 of the housing 12 proximate an intersection of the case portion 14 and the folder portion 48 of the housing 12. The handle 88 may be gripped by the user 64 so the user 64 may carry the assembly 10. Continuing, a strap 92 is coupled to a back side 94 of the back portion 60 of the folder portion 48 of the housing 12. The strap 92 extends between each of a top 96 and a bottom 98 of the back portion 60 of the folder portion 48 of the housing 12.

The strap 92 is one of a pair of the straps 92 each positioned proximate an associated one of the first lateral edge 58 and a second lateral edge 11 of the back portion 60 of the folder portion 48 of the housing 12. The pair of straps 92 is positionable around each of the user's shoulders 13 so the housing 12 is retained on the user's back 15. A clip 17 is coupled to an inside surface 19 of the back portion 60 of the folder portion 48 of the housing 12 proximate a top 21 of the back portion 60 of the folder portion 48 of the housing 12.

In use, the user 64 places items to be stored in either the case portion 14 or the folder portion 48 of the housing 12. The user 64 utilizes the case portion 14 of the housing 12 to organize durable items. Moreover, the user 64 utilizes the folder portion 48 of the housing 12 to organize pages or other items that cannot be folded or otherwise deformed. The user 64 may carry the assembly by the handle 88 in order to use the assembly 10 in the convention of the briefcase. Lastly, the user 64 may position the straps 92 around the user's shoulders 13 to use the assembly 10 in the convention of a backpack.

With respect to the above description, it is to be realized that the optimum dimensional relationship for the various components of the multipurpose carrying assembly 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the multipurpose carrying assembly 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A multipurpose carrying assembly for carrying items on a user's back or in a user's hand comprising:

a housing configured to carry a plurality of items, said housing comprising;

a case portion of said housing configured to store the items;

a folder portion of said housing coupled to said case portion of said housing wherein said folder portion of said housing is configured to store items; and a handle coupled to said housing wherein said handle is configured to be gripped;

a strap coupled to said housing wherein said strap is configured to be positionable on the user wherein said housing is retained on the user;

said housing having a cubic shape wherein said housing is configured to store the plurality of items in an interior of said housing;

a primary access slot extending along a first lateral side, a top side and a second lateral side of said case portion of said housing to access an interior of said case portion of said housing;

a primary fastener coupled to a perimeter edge of a primary access slot wherein said fastener selectively closes said primary access slot;

wherein a secondary access slot extending through a front side of said case portion of said housing to access an interior of said case portion of said housing; wherein a secondary fastener coupled to a perimeter edge of a secondary access slot wherein said secondary fastener selectively closes said secondary access slot;

wherein a pocket coupled to a front side of said case portion of said housing wherein said pocket is positioned below a secondary access slot; wherein a pocket slot extending through a front side of a pocket to access an interior of said pocket;

wherein a pocket fastener coupled to a perimeter edge of a pocket slot wherein said pocket fastener selectively closes said pocket slot.

2. The assembly according to claim 1 wherein a front side of a front portion of said folder portion of said housing coupled to a back side of said case portion of said housing.

3. The assembly according to claim 1 wherein a first lateral edge of a back portion of said folder portion of said housing being hingedly coupled to a second lateral edge of a front portion of said folder portion of said housing; wherein said folder portion of said housing being positionable in an open position wherein a back portion of said folder portion of said housing extends laterally away from a front portion of said folder portion of said housing wherein an interior of said folder portion of said housing is accessible to the user.

4. The assembly according to claim 1 wherein said folder portion of said housing being positionable in a closed position wherein a raised perimeter edge of a back portion of said folder portion of said housing coextensively abuts a raised perimeter edge of a front portion of said folder portion of said housing wherein an interior of said folder portion of said housing is concealed.

5. The assembly according to claim 1 wherein said handle being coupled to a top side of an outer wall of said housing proximate an intersection of said case portion and said folder portion of said housing.

6. The assembly according to claim 1 wherein said strap being coupled to a back side of a back portion of said folder portion of said housing wherein said strap extends between each of a top side and a bottom side of said back portion of said folder portion of said housing.

7. The assembly according to claim 3 wherein said strap being one of a pair of said straps each positioned proximate an associated one of a first lateral edge and a second lateral edge of said back portion of said folder portion of said housing.

8. The assembly according to claim 4 wherein said pair of straps being positionable around each of a user's shoulders wherein said housing is retained on the user's back.

9. The assembly according to claim 1 wherein a top pocket coupled to an inside surface of a front portion of said folder portion of said housing proximate a top of said front portion of said folder portion of said housing.

10. The assembly according to claim 1 wherein a bottom pocket coupled an inside surface of a front portion of said folder portion of said housing proximate a bottom of said front portion of said folder portion of said housing.

11. A multipurpose carrying assembly for carrying items on a user's back or in a user's hand comprising:

a housing configured to carry a plurality of items, said housing comprising;

a case portion of said housing configured to store the items;

a folder portion of said housing coupled to said case portion of said housing wherein said folder portion of said housing is configured to store items; and a handle coupled to said housing wherein said handle is configured to be gripped;

a strap coupled to said housing wherein said strap is configured to be positionable on the user wherein said housing is retained on the user;

said housing having a cubic shape wherein said housing is configured to store the plurality of items in an interior of said housing;

a primary access slot extending along a first lateral side, a top side and a second lateral side of said case portion of said housing to access an interior of said case portion of said housing;

a primary fastener coupled to a perimeter edge of a primary access slot wherein said fastener selectively closes said primary access slot;

wherein a first lateral edge of a back portion of said folder portion of said housing being hingedly coupled to a second lateral edge of a front portion of said folder portion of said housing; wherein said folder portion of said housing being positionable in an open position wherein a back portion of said folder portion of said housing extends laterally away from a front portion of said folder portion of said housing wherein an interior of said folder portion of said housing is accessible to the user;

wherein said folder portion of said housing being positionable in a closed position wherein a raised perimeter edge of a back portion of said folder portion of said housing coextensively abuts a raised perimeter edge of a front portion of said folder portion of said housing wherein an interior of said folder portion of said housing is concealed;

wherein a secondary access slot extending through a front side of said case portion of said housing to access an interior of said case portion of said housing; wherein a secondary fastener coupled to a perimeter edge of a secondary access slot wherein said secondary fastener selectively closes said secondary access slot; wherein a pocket coupled to a front side of said case portion of said housing wherein said pocket is positioned below a secondary access slot; wherein a pocket slot extending through a front side of a pocket to access an interior of said pocket;

wherein a pocket fastener coupled to a perimeter edge of a pocket slot wherein said pocket fastener selectively closes said pocket slot; wherein a front side of a front portion of said folder portion of said housing coupled to a back side of said case portion of said housing.

12. The assembly according to claim 11 wherein said handle being coupled to a top side of an outer wall of said housing proximate an intersection of said case portion and said folder portion of said housing.

13. The assembly according to claim 12 wherein said strap being coupled to a back side of a back portion of said folder portion of said housing wherein said strap extends between each of a top side and a bottom side of said back portion of said folder portion of said housing.

14. The assembly according to claim 11 wherein said strap being one of a pair of said straps each positioned proximate an associated one of a first lateral edge and a second lateral edge of said back portion of said folder portion of said housing; wherein said pair of straps being positionable around each of a user's shoulders wherein said housing is retained on the user's back.

15. The assembly according to claim 11 wherein a top pocket coupled to an inside surface of a front portion of said folder portion of said housing proximate a top of said front portion of said folder portion of said housing; wherein a bottom pocket coupled an inside surface of a front portion of said folder portion of said housing proximate a bottom of said front portion of said folder portion of said housing.

* * * * *